US005362357A

United States Patent [19]

Takei et al.

[11] Patent Number: 5,362,357

[45] Date of Patent: Nov. 8, 1994

[54] METHOD OF MANUFACTURING COLOR SELECTING MASK

[75] Inventors: Shinzo Takei, Tokyo; Hiroyuki Ida, Tochigi, both of Japan

[73] Assignees: Sony Corporation; Sony Chemicals Corporation, both of Tokyo, Japan

[21] Appl. No.: 181,911

[22] Filed: Jan. 18, 1994

[30] Foreign Application Priority Data

Jan. 18, 1993 [JP] Japan ..... 5-006070

[51] Int. Cl.[5] ..... B44C 1/22; C23F 1/00

[52] U.S. Cl. ..... 156/634; 156/630; 156/644; 156/651; 156/661.1

[58] Field of Search ..... 156/629, 630, 634, 640, 156/644, 651, 656, 659.1, 661.1

[56] References Cited

U.S. PATENT DOCUMENTS

| | | | |
|---|---|---|---|
| 4,069,085 | 1/1978 | Buysman et al. | 156/640 X |
| 4,861,422 | 8/1989 | Kudou et al. | 156/640 |
| 5,200,025 | 4/1993 | Toei et al. | 156/644 X |

*Primary Examiner*—William Powell

*Attorney, Agent, or Firm*—Hill, Steadman & Simpson

[57] ABSTRACT

A color selecting mask such as an aperture grille for use in a color cathode-ray tube a plurality of parallel slots or apertures defined transversely in a thin metal sheet. To manufacture the color selecting mask, a peelable pressure-sensitive adhesive sheet such as an ultraviolet-curing pressure-sensitive adhesive sheet or a heat-foaming pressure-sensitive adhesive sheet is applied to one surface of a thin metal sheet, and the thin metal sheet is selectively etched to form slots or apertures therein.

13 Claims, 10 Drawing Sheets

METHOD OF MANUFACTURING COLOR SELECTING MASK

BACKGROUND OF THE INVENTION

1. Field of the Invention

The present invention relates to a method of manufacturing a color selecting mask.

2. Description of the Related Art

Color cathode-ray tubes have a color selecting mask positioned in confronting relation to a color phosphor screen for controlling scanning electron beams corresponding to respective colors to land on the patterns of color phosphors.

In general color cathode-ray tubes, the color selecting mask comprises a shadow mask having a plurality of circular beam passage holes each corresponding to a triplet of red, green, and blue phosphor dots on the color phosphor screen.

The shadow mask comprises a metallic sheet pressed to a slightly domed shape, and has its peripheral edges welded to and held by a frame. Since the shadow mask is held by the frame without being tensioned, the shadow mask suffers doming which causes the displayed colors to be shifted out of registry when the temperature of the shadow mask is increased by the scanning electron beams and the shadow mask is expanded by the heat. To avoid such a drawback, it is customary to construct the shadow mask of an expensive material having a low coefficient of expansion and increase the thickness of the shadow mask for greater mechanical strength.

A Trinitron (registered trademark) color cathode-ray tube has a color selecting mask in the form of an aperture grille or slot mask that confronts a color phosphor screen of the tube.

The color phosphor screen has an array of parallel vertical stripes (not shown) of red, green, and blue phosphors. The color selecting mask lying in facing relationship to the color phosphor screen has a plurality of parallel vertical slots or apertures for passing an electron beam therethrough, the slots extending along the vertical phosphor stripes on the color phosphor screen from the upper to lower edge of at least an entire effective screen area.

The slots are defined in a thin metal sheet of highly pure iron that has a thickness ranging from 0.08 to 0.15 mm. The thin metal sheet is supported on a centrally open frame.

The frame comprises a pair of confronting sides spaced from each other and a pair of confronting arms spaced from each other and extending between the sides. The sides have respective arcuate front end surfaces which are part of a cylindrical surface, and the thin metal sheet is placed on and extends between the sides.

The thin metal sheet is installed on the frame as follows: The sides are pulled toward each other by a turnbuckle, and then the thin metal sheet is fixed to the arcuate front end surfaces of the sides by welding its opposite edges near the ends of the slots. Thereafter, the turnbuckle is removed to release the frame of the forces that have been applied to the sides by the turnbuckle. Therefore, the web regions between the slots of the thin metal sheet are held under tension along the slots due to the tendency of the frame to recover its shape.

Recent demands for larger-size color cathode-ray tubes have resulted in longer web regions between the slots of the thin metal sheet. The longer web regions are, however, more liable to vibrate owing to voices and shocks applied when the electron beam passes through the aperture grille toward the color phosphor screen, shifting the displayed colors out of proper registration.

For suppressing the vibration of the web portions of the thin metal sheet, it has been customary practice to increase the thickness of the thin metal sheet for higher rigidity or increase the thickness of the frame for greater resilient recovery forces.

One process of defining the slots in the thin metal sheet which is relatively thick for vibration suppression is to etch the thin metal sheet on its opposite surfaces using photolithography.

Such an etching process will be described below with reference to FIGS. 1A through 1D of the accompanying drawings. First, as shown in FIG. 1A, an etching mask 11A of photoresist having a striped pattern of openings 1WA is formed on one surface 1A of a thin metal sheet 1 by a photolithographic process including photoresist coating, exposure, development, and photoresist removal. Thereafter, another etching mask 11B of photoresist having a striped pattern of openings 1WB is formed on the opposite surface 1B of the thin metal sheet 1 by photolithography. The openings 1WB are aligned with, and wider than, the respective openings 1WA.

Then, as shown in FIG. 1B, the thin metal sheet 1 is etched on both the surfaces 1A, 1B with an etching solution of ferric chloride ($FeCl_3$), for example, to form grooves in the opposite surfaces 1A, 1B through the openings 1WA, 1WB in the etching masks 11A, 11B.

Thereafter, as shown in FIG. 1C, a protective film 12 of varnish, for example, is deposited in the grooves in the surface 1A. Using the protective film 12 as an etching mask, the thin metal sheet 1 is etched again on the surface 1B relatively gradually with an etching solution of $FeCl_3$, for example, having a relatively low concentration until the protective film 12 is exposed in the grooves in the surface 1B, as shown in FIG. 1D.

Subsequently, the protective film 12 is removed. In this manner, a striped pattern of slots 2 for the passage of an electron beam therethrough are defined in the thin metal sheet 1. As shown in FIG. 2 of the accompanying drawings, the slots 2 extend longitudinally perpendicularly to the sheet of FIG. 2, and each have a cross-sectional shape of "8". Since the thin metal sheet 1 is etched twice, at a lower etching rate in the second etching step, the etching time can be controlled more easily and reliably than if the thin metal sheet 1 were etched once, even though the thin metal sheet 1 is relatively thick. Consequently, the thin metal sheet 1 is prevented from being excessively etched, and can be etched to a desired depth accurately. As a result, the effective width of each of the slots 2, i.e., the distance SW between opposite edges 5 formed in each of the slots 2 by the etching process, can be controlled highly accurately in the thin metal sheet 1 that is relatively thick. One problem with the above etching process is that the efficiency is lower than if the thin metal sheet 1 were etched once.

With the edges 5 formed, the slot 2 is defined by curved tapered surfaces 6 extending from the opposite surfaces 1A, 1B to the edges 5.

FIG. 3 of the accompanying drawings illustrate, in cross section, the manner in which an electron beam is applied through the color separating mask 4 to a color phosphor screen 10. In FIG. 3, an electron beam Ei travels through a slot 2 to the color phosphor screen 10 and hits the striped color phosphors for colored light emission. The color phosphor screen 10 produces an electron beam $Er_1$ due to secondary electron emission, and the electron beam $Er_1$ is reflected by the surface of the color separating mask 4 and a curved tapered surface 6, resulting in scattered electron beams Es and a reflected electron beam $Er_2$. Consequently, the color phosphor screen 10 generate colors inaccurately, and the contrast and purity of the generated colors are lowered. If the slots 2 were formed in the color separating mask 4 in one etching step, however, the areas of the curved tapered surfaces 6 would further be increased, and the contrast and purity of the generated colors would further be lowered.

As described above, the color separating masks of the general Trinitron color cathode-ray tubes are composed of a thin metal sheet of relatively large thickness. However, inasmuch as the thin metal sheet of relatively large thickness is relatively heavy, the Trinitron color cathode-ray tubes are also relatively heavy.

The effective width SW (see FIG. 2) of each of the slots 2 is about 50% of the thickness t of the thin metal sheet 1 due to limitations posed by the etching process. Because the thin metal sheet 1 is of relatively large thickness, the width SW of each slot 2 is also relatively large in proportion to the thickness of the thin metal sheet 1. As a result, the slots 2 are not defined at a high density or in a fine pattern.

In an effort to solve the above problems, the applicant has proposed a color cathode-ray tube having a color selecting mask or aperture grille that is of improved accuracy, can be manufactured at an increased rate of production, has a reduced weight, and includes slots or apertures defined in a fine pattern.

As disclosed in Japanese laid-open patent publication No. 4-126341, the proposed color cathode-ray tube includes a color phosphor screen having parallel striped patterns of respective color phosphors and a color separating mask in the form of an aperture grille positioned in confronting relationship to the color phosphor screen and having a number of parallel slots or apertures extending along the parallel striped patterns of respective color phosphors for passing an electron beam therethrough. The slots are defined in a thin metal sheet which is mounted on a centrally open frame and kept taut under tension along the slots. The thin metal sheet has a small thickness of 0.05 mm or less.

Although the thickness of the thin metal sheet is small, it has been possible to suppress vibrations of the web portions thereof between the slots, which vibrations would otherwise be caused by voices and shocks applied thereto. The reasons for the suppressed vibrations are as follows:

If each of the web portions between the slots or apertures of the color selecting mask is regarded as a chord, then the resonant frequency f of the chord is given by the following equation:

$$f=(gt/\rho)^{\frac{1}{2}}/2Ls$$

where g is the gravitational acceleration, $\rho$ the linear density of the chord, T the stress developed in the chord, and Ls the length of the chord. Heretofore, if the length Ls of the chord increases as the size of the color cathode-ray tube increases, then the stress T is increased to increase the resonant frequency f away from a main range frequencies of vibrations caused by voices and shocks. According to the proposed color cathode-ray tube, the thickness of the thin metal sheet of the color selecting mask is reduced to reduce the linear density $\rho$ of the chord, so that the resonant frequency f is increased away from a main range of frequencies of vibrations caused by voices and shocks. Therefore, even though the thickness of the thin metal sheet is increased, the vibrations of the web portions of the thin metal sheet are suppressed. The proposed color cathode-ray tube can thus prevent produced colors from being brought out of registry owing to voice- and shock-induced vibrations, and can display high-quality colored images on the color phosphor screen.

FIG. 4 of the accompanying drawings shows, in cross section, a thin metal sheet 1 of a color selecting mask or aperture grill 4 of the proposed color cathode-ray tube. As shown in FIG. 4, the thin metal sheet 1 is so thin that slots or apertures 2 can accurately be defined in the thin metal sheet 1 in one etching step effected on one surface thereof. Since the time required to etch the thin metal sheet 1 is shortened, the rate of production is improved. In addition, the material of the thin metal sheet 1 is reduced, and the color selecting mask 4 can be manufactured with an increased yield.

Because the width SW of each of the slots 2 that are formed by etching is about 50% of the thickness t of the thin metal sheet 1, the width SW is relatively small as the thickness of the thin metal sheet 1 is small. The color selecting mask 4 is highly accurate in dimensions, and the slots 2 are defined at a high density or in a fine pattern.

As the thickness of the thin metal sheet 1 is small, the areas of curved tapered surfaces 6 of the holes 2 are also small. As shown in FIG. 5 of the accompanying drawings, therefore, any electron beams Es, $Er_2$ reflected and scattered by the curved tapered surfaces 6 are suppressed. Consequently, any deterioration of the contrast and purity of colors produced by the color cathode-ray tube is minimized for displaying finely defined images on the color phosphor screen 10.

Reducing the thickness of the thin metal sheet 1 makes it possible to reduce the rigidity and weight of the frame that supports the thin metal sheet 4. The reduced frame weight is in turn effective to reduce the amount of electric energy that is required to be supplied to a degaussing coil that demagnetize an external magnetic field applied to the color cathode-ray tube. The electric power requirement of the color cathode-ray tube is lowered, and the color cathode-ray tube can reliably be demagnetized.

If, however, the thickness of the thin metal sheet of the color cathode-ray tube is smaller than 0.08 mm, particularly 0.05 mm as disclosed in Japanese laid-open patent publication No. 4-126341, then some difficulty arises as to the handling of the thin metal sheet itself.

More specifically, when slots or apertures are defined in the thin metal sheet, or when the thin metal sheet with the slots or apertures defined therein is inspected for any defects, or when the inspected thin metal sheet is welded to the frame, since the thin metal sheet is very thin and has the slots or apertures defined therein, with the web portions being joined only at the opposite ends of the thin metal sheet and hence soft and unstable, the web portions tend to be flexed, bent, and intertwined, causing wrinkles in themselves or joined ends thereof.

Once such wrinkles are produced, they are liable to remain in the thin metal sheet even when the thin metal sheet is subsequently mounted on the frame and kept taut under tension on the frame. Even if the thin metal sheet itself is found not defective, the eventual color selecting mask with the wrinkles is unable to land the electron beam accurately on desired color phosphors on the color phosphor screen. The color cathode-ray tube thus produced is defective and cannot be shipped from the factory. Accordingly, the yield of proposed color cathode-ray tubes is low.

In view of the fact that large-size color cathode-ray tubes for high-definition television (HDTV) are finding widespread use, thin metal sheets for use as aperture grilles in large-size and high-quality color cathode-ray tubes pose similar handling problems even when the thickness of the thin metal sheets is greater than 0.08 mm.

OBJECTS AND SUMMARY OF THE INVENTION

It is an object of the present invention to provide a method of manufacturing a color selecting mask in the form of an aperture grille with a high yield, for use in a color cathode-ray tube.

According to the present invention, there is provided a method of manufacturing a color selecting member for use in a color cathode-ray tube, the color selecting member having a plurality of parallel slots defined transversely in a thin metal sheet, comprising the steps of (a) applying a peelable pressure-sensitive adhesive sheet to one surface of a thin metal sheet, and (b) selectively etching the thin metal sheet from an opposite surface thereof.

The peelable pressure-sensitive adhesive sheet may comprise an ultraviolet-curing pressure-sensitive adhesive sheet. The method may further comprise the step of applying ultraviolet radiation to the peelable pressure-sensitive adhesive sheet after the step (b), or the step of applying ultraviolet radiation to the peelable pressure-sensitive adhesive sheet after the step (a) and additionally the step of applying ultraviolet radiation to the peelable pressure-sensitive adhesive sheet after the step (b).

The peelable pressure-sensitive adhesive sheet may comprise a heat-foaming pressure-sensitive adhesive sheet. The method may further comprise the step of heating the peelable pressure-sensitive adhesive sheet to foam after the step (b).

The method may further comprise the step of inspecting the selectively etched thin metal sheet after the step (b).

The method may further comprise the steps of (c) mounting the thin metal sheet under tension on a frame after the step (b), and (d) peeling the peelable pressure-sensitive adhesive sheet off the thin metal sheet after the step (c) .

The thin metal sheet may have a thickness of 0.15 mm or below.

According to the present invention, there is also provided a method of manufacturing a color cathode-ray tube having a color selecting member having a plurality of parallel slots defined transversely in a thin metal sheet, comprising the steps of (a) applying a peelable pressure-sensitive adhesive sheet to one surface of a thin metal sheet, and (b) selectively etching the thin metal sheet from an opposite surface thereof. The peelable pressure-sensitive adhesive sheet may comprise an ultraviolet-curing pressure-sensitive adhesive sheet or a heat-foaming pressure-sensitive adhesive sheet.

The above and other objects, features, and advantages of the present invention will become apparent from the following description of illustrative embodiments thereof to be read in conjunction with the accompanying drawings, in which like reference numerals represent the same or similar objects.

DETAILED DESCRIPTION OF THE PREFERRED EMBODIMENTS

Figure 1A:
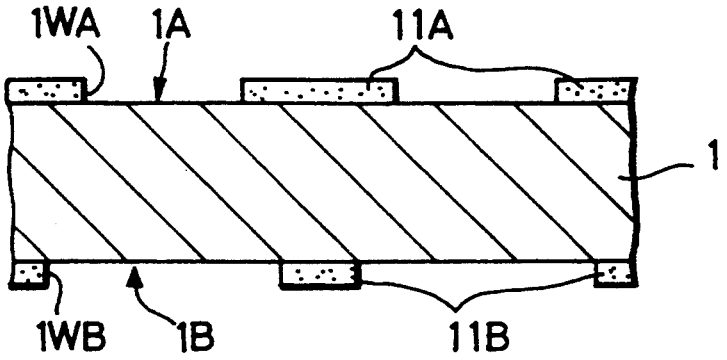
FIG. 1A (PRIOR ART)
FIGS. 1A through 1D are cross-sectional views illustrative of a conventional method of manufacturing a color selecting mask for use in a color cathode-ray tube.
Figure 1B:
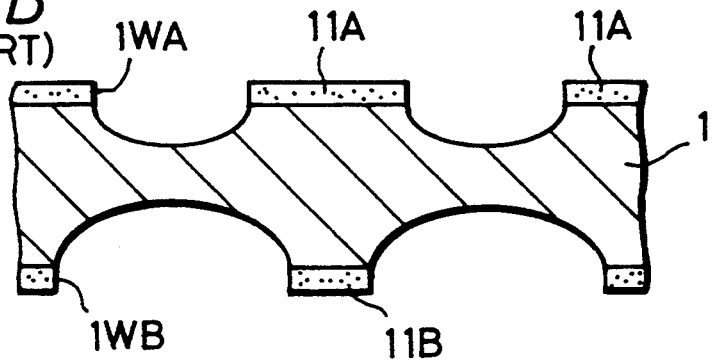
FIG. 1B (PRIOR ART)
Figure 1C:
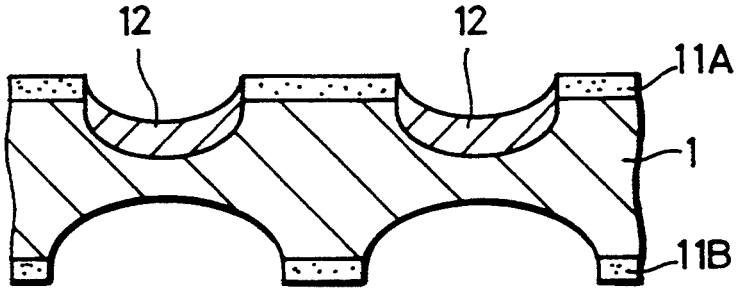
FIG. 1C (PRIOR ART)
Figure 1D:
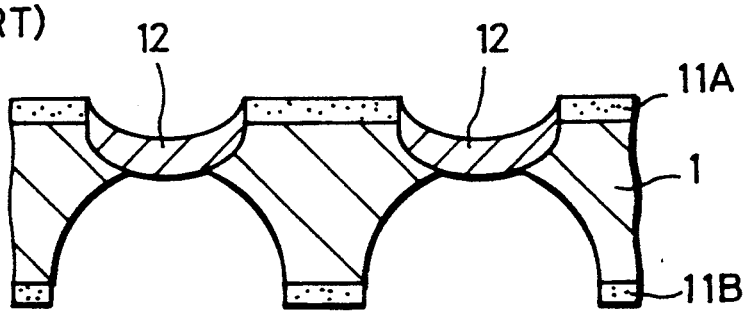
FIG. 1D (PRIOR ART)
Figure 2:
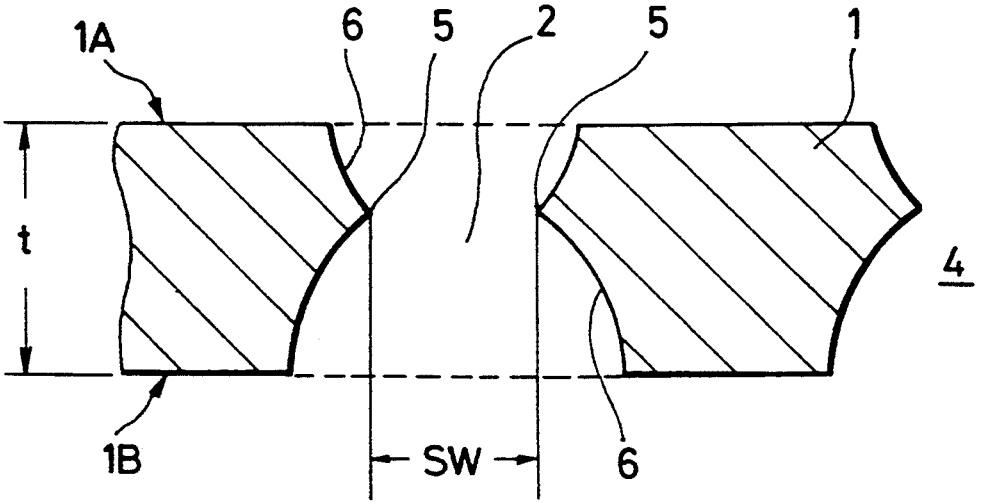
FIG. 2 (PRIOR ART)
FIG. 2 is an enlarged fragmentary cross-sectional view of a conventional color selecting mask.
Figure 3:
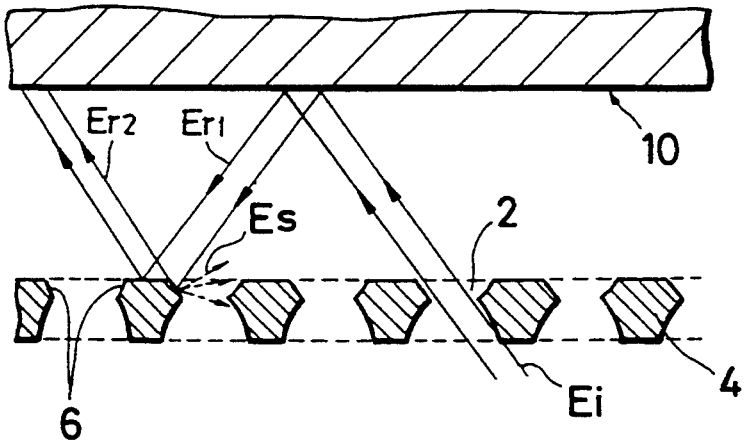
FIG. 3 (PRIOR ART)
FIG. 3 is an enlarged fragmentary cross-sectional view showing the manner an electron beam is applied through the color selecting mask shown in FIG. 2 to a color phosphor screen.
Figure 4:
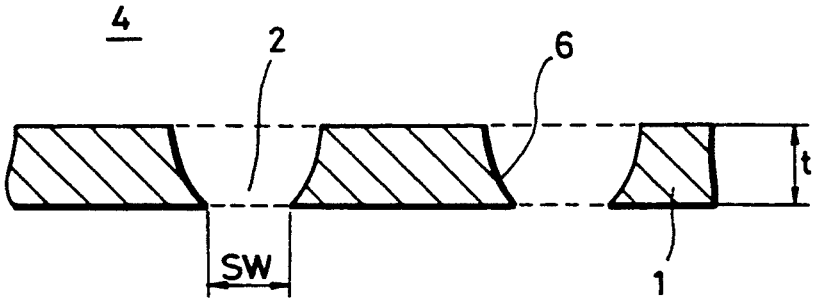
FIG. 4 (PRIOR ART)
FIG. 4 is an enlarged fragmentary cross-sectional view of another conventional color selecting mask.
Figure 5:
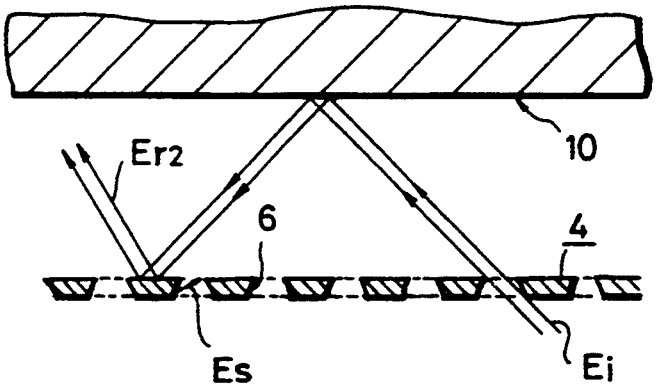
FIG. 5 (PRIOR ART)
FIG. 5 is an enlarged fragmentary cross-sectional view showing the manner an electron beam is applied through the color selecting mask shown in FIG. 4 to a color phosphor screen.
Figure 6:
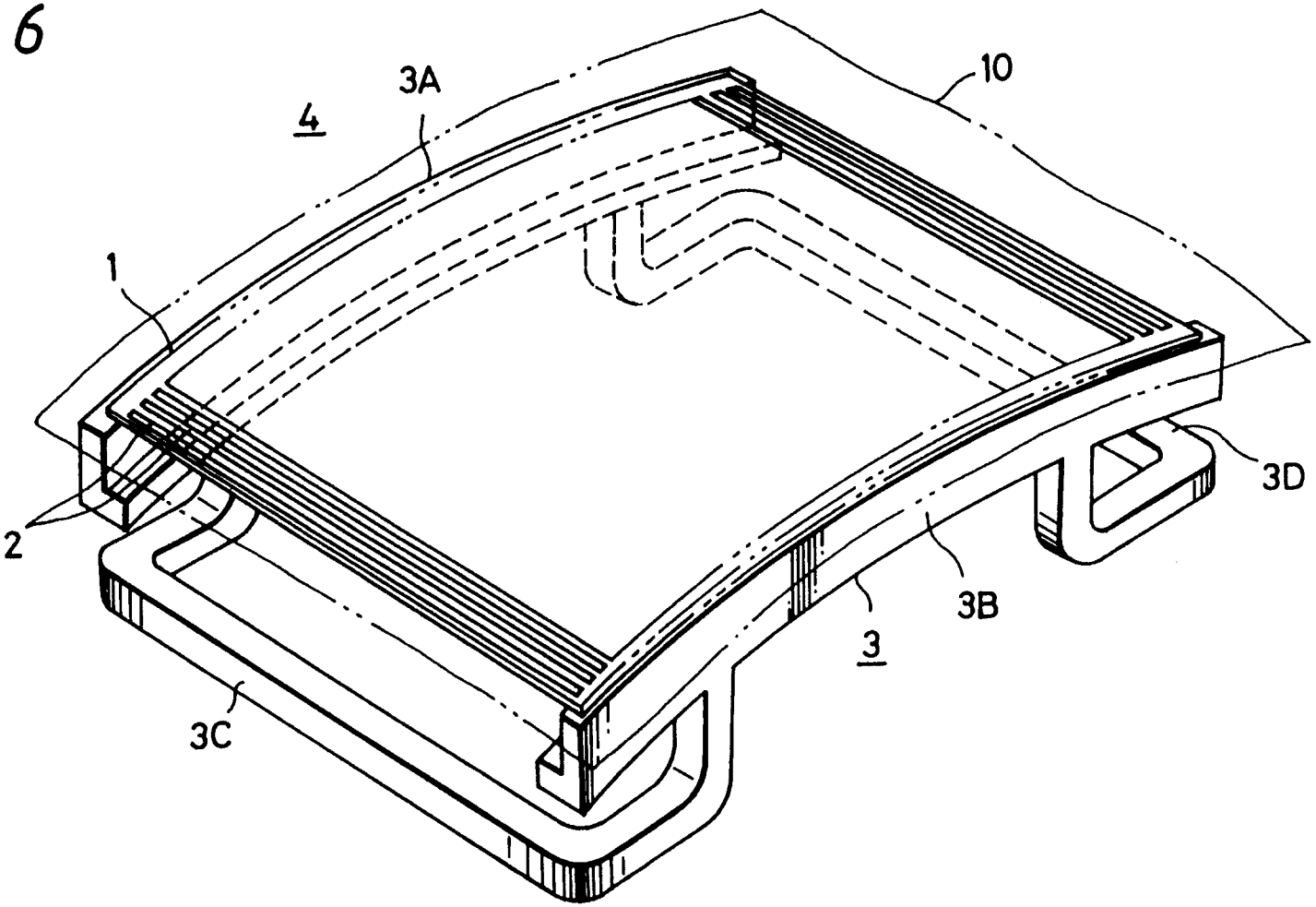
FIG. 6 is a perspective view of a color selecting mask produced according to the present invention.

As shown in FIG. 6, a color selecting mask 4 for use in a Trinitron color cathode-ray tube, for example, which is produced according to the present invention is the form of an aperture grille or slot mask that confronts a color phosphor screen 10 having an array of parallel vertical stripes (not shown) of red, green, and blue phosphors. The color selecting mask 4 has a plurality of parallel vertical slots or apertures 2 for passing an electron beam therethrough, the slots 2 extending along the vertical phosphor stripes on the color phosphor screen 10 from upper to lower edges of at least an entire effective screen area. The slots 2 are defined transversely in a thin metal sheet 1 of highly pure iron that has a thickness of 0.15 mm or smaller, e.g., 0.08 mm or smaller. The thin metal sheet 1 is supported on a frame 3. The frame 3 comprises a pair of confronting sides 3A, 3B spaced from each other and a pair of confronting arms 3C, 3D spaced from each other and extending between the sides 3A, 3B. The sides 3A, 3B have arcuate front end surfaces which are part of a cylindrical surface, and the thin metal sheet 1 is placed on and extends between the sides 3A, 3B.

The thin metal sheet 1 is installed on the frame 3 as follows: The sides 3A, 3B are pulled toward each other by a turnbuckle, and then the thin metal sheet 1 is fixed to the arcuate front end surfaces of the sides 3A, 3B by welding its opposite edges near the ends of the slots 2 through electric welding, laser welding, or the like. Thereafter, the turnbuckle is removed to release the frame 3 of the forces that have been applied to the sides 3A, 3B by the turnbuckle. Therefore, the web regions between the slots 2 of the thin metal sheet 1 are held under tension along the slots 2 due to the tendency of the frame 3 to recover its shape.

Figures 7A, 7B, 7C:
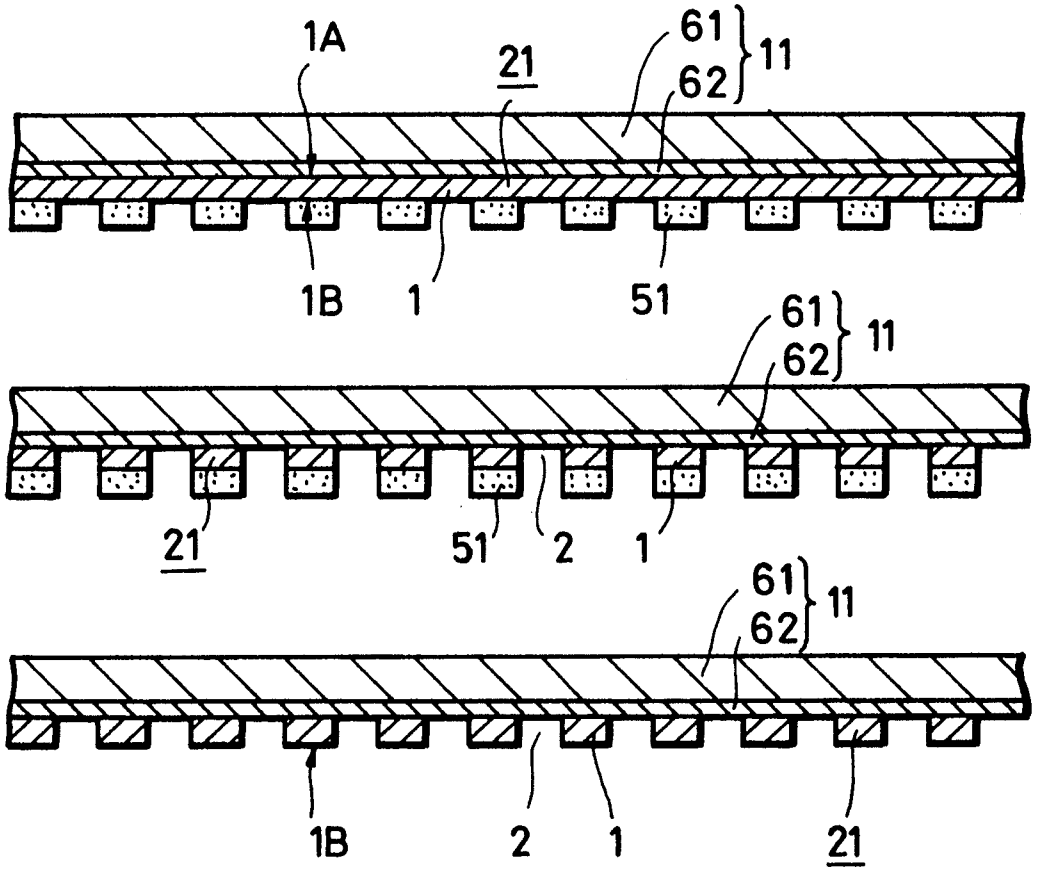
FIGS. 7A through 7C are fragmentary cross-sectional views illustrative of a method of manufacturing a color selecting mask according to the present invention.

The color selecting mask 4 is manufactured as follows: As shown in FIG. 7A, a reactive repeelable adhesive sheet 11 is applied to one surface 1A of a thin metal sheet 1, and a photoresist layer 51 having a plurality of slots or apertures is applied to the opposite surface 1B of the thin metal sheet 1. Then, the thin metal sheet 1 is selectively etched from its opposite surface 1B to form a plurality of slots or apertures 2 therein through the photoresist layer 51, as shown in FIG. 7B. Thereafter, the photoresist layer 51 is removed as shown in FIG. 7C.

The process of manufacturing the color selecting mask 4 will be described in greater detail below.

A plurality of thin metal sheets 1 are successively produced by selective etching from an elongate continuous tape of thin metal sheet having a predetermined width.

The reactive repeelable adhesive sheet 11 is in the form of an ultraviolet-curing pressure-sensitive adhesive sheet.

Figure 9:
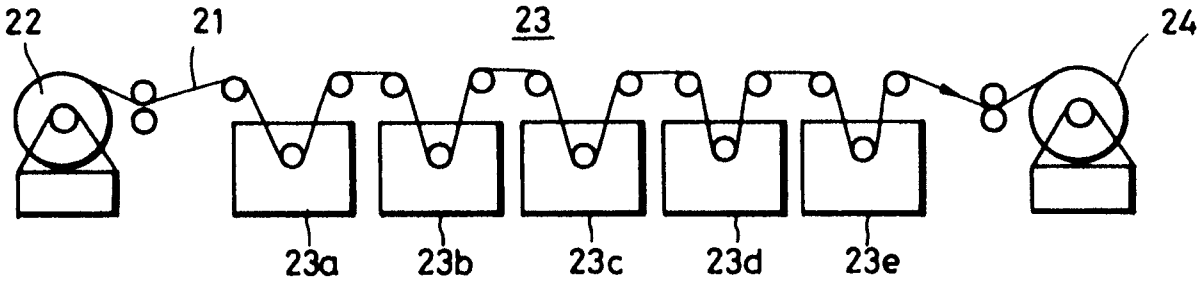
FIG. 9 is a schematic view illustrative of a step of the method according to the present invention.

As shown in FIG. 9, a plurality of thin metal sheets 1 may be produced successively at certain intervals from an elongate tape of thin metal sheet 21, which comprises a smooth aluminum-killed low-carbon steel sheet having a thickness of 0.15 mm or lower, e.g., in the range of from 0.025 to 0.05 mm. The elongate tape of thin metal sheet 21 is supplied from a supply roll 22 of such thin metal sheet. The thin metal sheet 21 supplied from the supply roll 22 is cleaned by a cleaning device 23.

The cleaning device 23 comprises a plurality of processing units 23*a* through 23*e* through which the thin metal sheet 21 is successively fed. The processing units 23*a* through 23*e* include a washing unit 23*a* for washing the thin metal sheet 21 with sodium silicate, a washing unit 23*b* for washing the thin metal sheet 21 with water, a corrosion-prevention processing unit 23*c* for treating the thin metal sheet 21 against corrosion, a washing unit 23*c* for washing the thin metal sheet 21 with water, and a drying unit 23*e* for drying the thin metal sheet 21. The thin metal sheet 21 thus processed by the cleaning device 23 is temporarily wound on a takeup roll 24.

Figure 10:
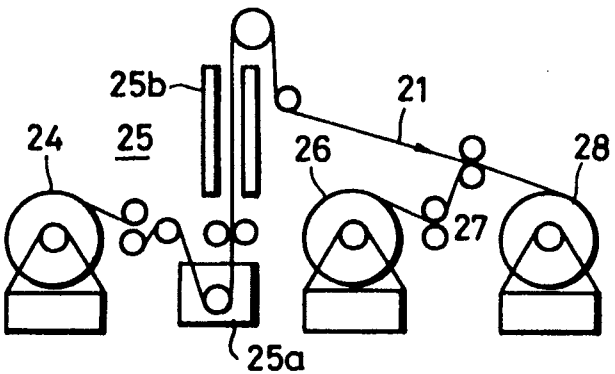
FIG. 10 is a schematic view illustrative of another step of the method according to the present invention.

Thereafter, as shown in FIG. 10, the thin metal sheet 21 is unwound from the takeup roll 24 and fed into a resist applying device 25. The resist applying device 25 applies a photoresist serving as a selective etching mask to one of the surfaces of the thin metal sheet 21. The resist applying device 25 comprises a resist applicator 25*a* for applying the photoresist to the surface of the thin metal sheet 21 as it moves therethrough, and a heater drier 25*b* for heating the applied photoresist layer to 60° C., for example, with a heater or a lamp thereby to dry the applied photoresist layer.

The thin metal sheet 21 with the photoresist layer thus applied is then superposed on a spacer sheet 27 supplied from a supply roll 26, and wound on a takeup roll 28.

Figure 11:
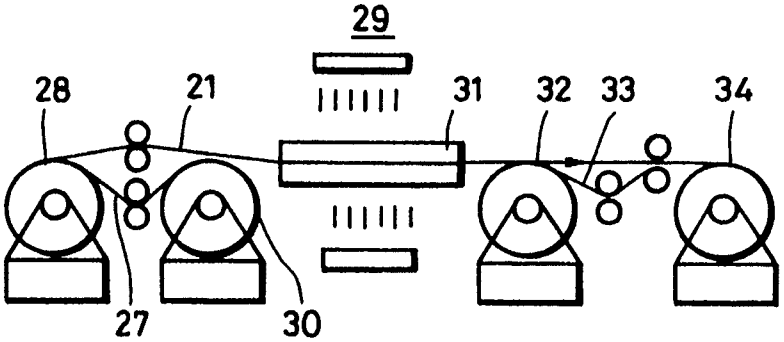
FIG. 11 is a schematic view illustrative of still another step of the method according to the present invention.

As illustrated in FIG. 11, the thin metal sheet 21 is thereafter unreeled from the takeup roll 28, separated from the spacer sheet 27, and delivered into an exposure device 29. The spacer sheet 27 separated from the thin metal sheet 21 is wound on a takeup roll 30.

The exposure device 29 includes an exposure plate 31 having a pattern representing the contour of the thin metal sheet 1 (see FIG. 6) and a pattern representing the slots or apertures 2 positioned within the contour of the thin metal sheet 1. The thin metal sheet 21 as it enters the exposure device 29 is brought into intimate contact with the exposure plate 31. Then, the photoresist layer on the thin metal sheet 21 is irradiated with ultraviolet radiation through the exposure plate 31, so that the exposed areas of the photoresist layer are hardened.

Then, the thin metal sheet 21 with the exposed photoresist layer is superposed on a spacer sheet 33 supplied from a supply roll 32, and wound on a takeup roll 34.

Figure 12:
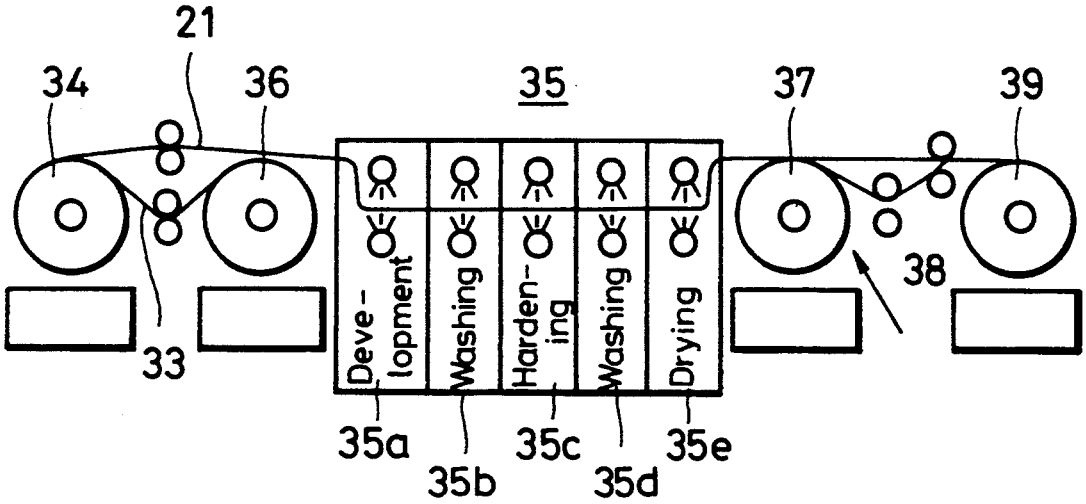
FIG. 12 is a schematic view illustrative of yet still another step of the method according to the present invention.

As shown in FIG. 12, the thin metal sheet 21 is unwound from the takeup roll 34, separated from the spacer sheet 33, and delivered into a developing/hardening device 35. The spacer sheet 33 separated from the thin metal sheet 21 is wound on a takeup roll 36.

The developing/hardening device 35 comprises a plurality of processing units 35*a* through 35*e* through which the thin metal sheet 21 is successively fed. The processing units 35*a* through 35*e* include a developing unit 35*a* for developing the exposed areas of the photoresist layer on the thin metal sheet 21, a washing unit 35*b* for washing the thin metal sheet 21 with water, a hardening unit 35*c* for hardening the photoresist layer, a washing unit 35*c* for washing the thin metal sheet 21 with water, and a drying unit 35*e* for drying the thin metal sheet 21. By thus passing through the developing/hardening device 35, the photoresist layer 51 (see FIG. 7A), which serves as an etching mask having a contour corresponding to the contour of the thin metal sheet 1 (see FIG. 6) and openings corresponding to the slots or apertures 2, is formed on the surface 1B of the thin metal sheet 21.

The thin metal sheet 21 with the photoresist layer 51 thereon is superposed on a heat-resistant sheet 38 supplied from a supply roll 37, and wound on a takeup roll 39.

Figure 13:
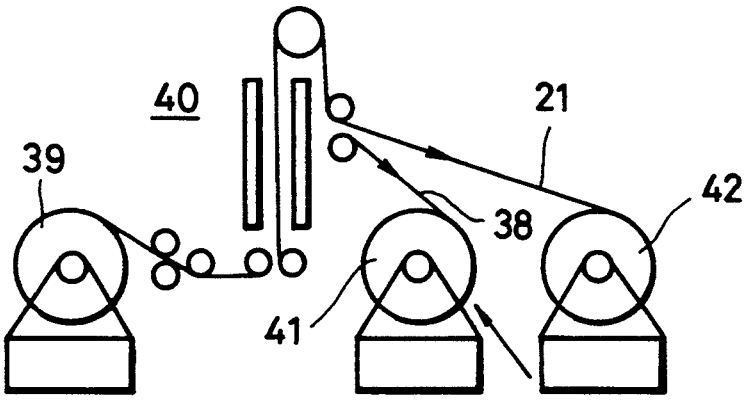
FIG. 13 is a schematic view illustrative of a further step of the method according to the present invention.

Then, as shown in FIG. 13, the thin metal sheet 21 with the photoresist layer 51 thereon is unwound from the takeup roll 39 is heated to 230° C., for example, with a heater or a lamp in a heating device 40 for post-baking thereby to mechanically and chemically stabilize the photoresist layer 51.

Thereafter, the heat-resistant sheet 38 is separated from the thin metal sheet 21 and wound on a takeup roll 41, and the thin metal sheet 21 is wound on a takeup roll 42.

Subsequently, as shown in FIG. 7A, the reactive repeelable adhesive sheet 11 in the form of an ultraviolet-curing pressure-sensitive adhesive sheet is applied to the surface 1A of the thin metal sheet 21 which is opposite to the surface 1B on which the photoresist layer 51 is formed.

Figure 14A:
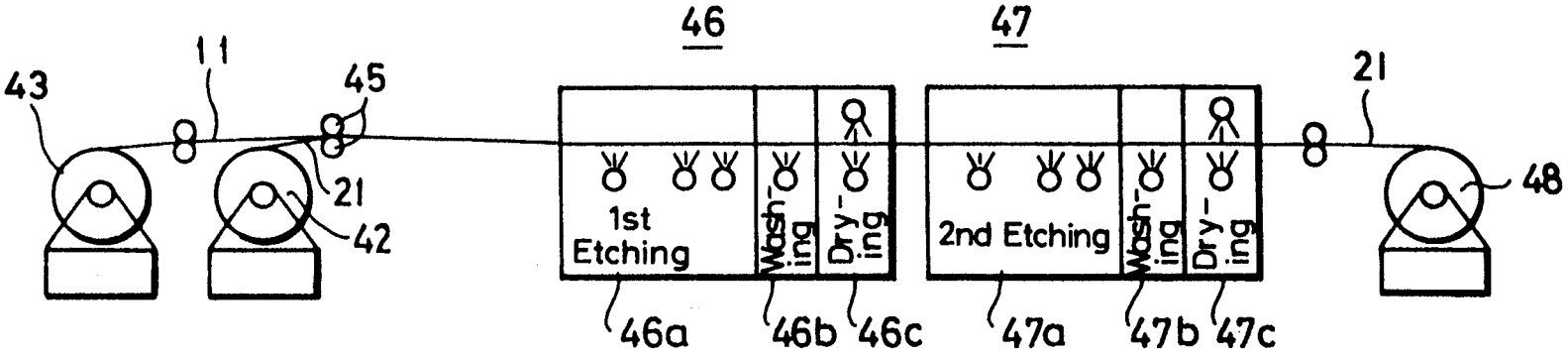
FIG. 14A is a schematic view illustrative of still further steps of the method according to the present invention.

More specifically, as shown in FIG. 14A, the reactive repeelable adhesive sheet 11 is unwound from a supply roll 43 and superposed on the surface 1A of the thin metal sheet 21 that is unwound from the takeup roll 42. The reactive repeelable adhesive sheet 11 is pressed against the thin metal sheet 21 by pressing rollers 45. The thin metal sheet 21 is thus lined with the reactive repeelable adhesive sheet 11.

Then, the thin metal sheet 21 is selectively etched through the photoresist layer 51 as an etching mask.

As shown in FIG. 14A, the thin metal sheet 21 is selectively etched by first and second etching processing devices 46, 47. In the first etching device 46, the thin metal sheet 21 is selectively etched at a relatively high etching rate. In the second etching device 47, the thin metal sheet 21 is selectively etched at a relatively low etching rate for high-precision etching. In the first and second etching devices 46, 47, the thin metal sheet 21 is selectively etched using an etching solution such as of ferric chloride. The etching rate is controlled by selecting the temperature and concentration of the etching solution.

The first etching device 46 comprises an etching unit 46*a* for etching the thin metal sheet 21, a washing unit 46*b* for washing the thin metal sheet 21 with water, and a drying unit 46*c* for drying the thin metal sheet 21. The second etching device 47 comprises an etching unit 47*a* for etching the thin metal sheet 21, a washing unit 47*b* for washing the thin metal sheet 21 with water, and a drying unit 47*c* for drying the thin metal sheet 21.

By thus selectively etching the thin metal sheet 21, the slots or apertures 2 are defined in the thin metal sheet 1 which is lined with the reactive repeelable adhesive sheet 11, as shown in FIG. 7B. The selectively etched thin metal sheet 1 is wound on a takeup reel 48.

Figure 15:
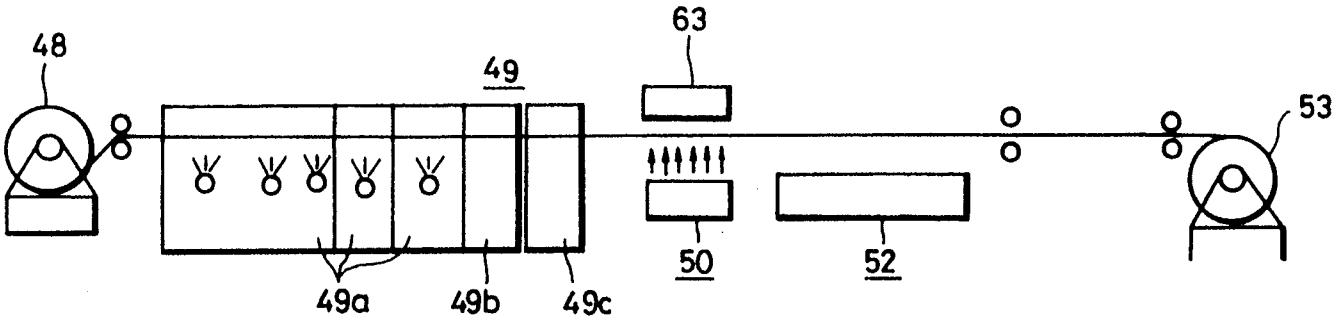
FIG. 15 is a schematic view illustrative of a yet still further step of the method according to the present invention.

Thereafter, as shown in FIG. 15, the selectively etched thin metal sheet 1 is unwound from the takeup reel 48, and the photoresist layer 51 is removed by a removing device 49. The removing device 49 comprises a removing unit 49*a* for applying a solution to remove the photoresist layer 41, a washing unit 49*b* for washing the thin metal sheet 1 with water, and a drying unit 49*c* for drying the thin metal sheet 1.

Figure 16:
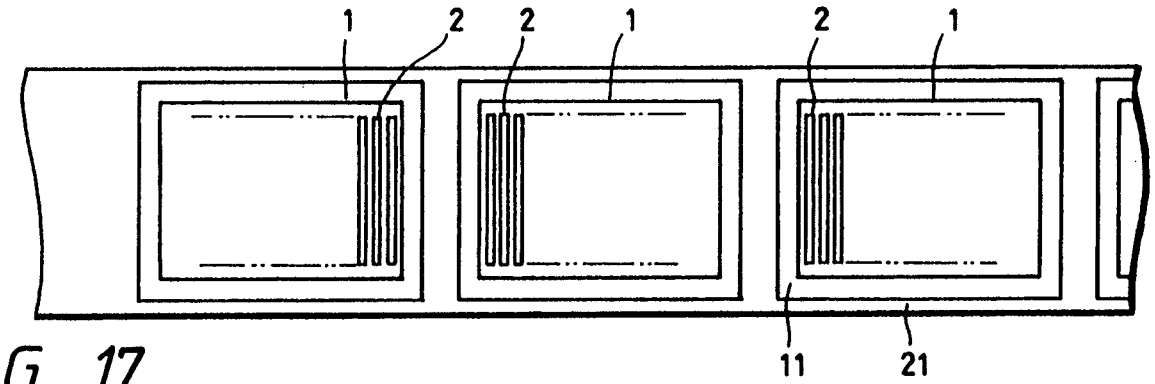
FIG. 16 is a fragmentary plan view of thin metal sheets supported on a reactive repeelable pressure-sensitive adhesive sheet.

In this manner, a plurality of thin metal sheets 1 each with parallel slots or apertures 2 defined therein are successively placed on the reactive repeelable pressure-sensitive adhesive sheet 11, as shown in FIG. 16. The thin metal sheets 1 are mechanically joined by the reactive repeelable adhesive sheet 11.

As shown in FIG. 15, the reactive repeelable adhesive sheet 11 is irradiated with ultraviolet radiation by an ultraviolet irradiator 50. By being irradiated with ultraviolet radiation, the reactive repeelable adhesive sheet 11 is hardened for increasing its peelability.

After or before being irradiated with ultraviolet radiation, each of the thin metal sheets 1 on the reactive repeelable adhesive sheet 11 is inspected by an inspecting device 52 through optical image processing, for example. Any defective thin metal sheets 1 may be peeled from the reactive repeelable adhesive sheet 11 or marked for subsequent rejection.

The reactive repeelable adhesive sheet 11 which supports the inspected thin metal sheets 1 is wound on a takeup roll 53 as shown in FIG. 15.

Figure 8:
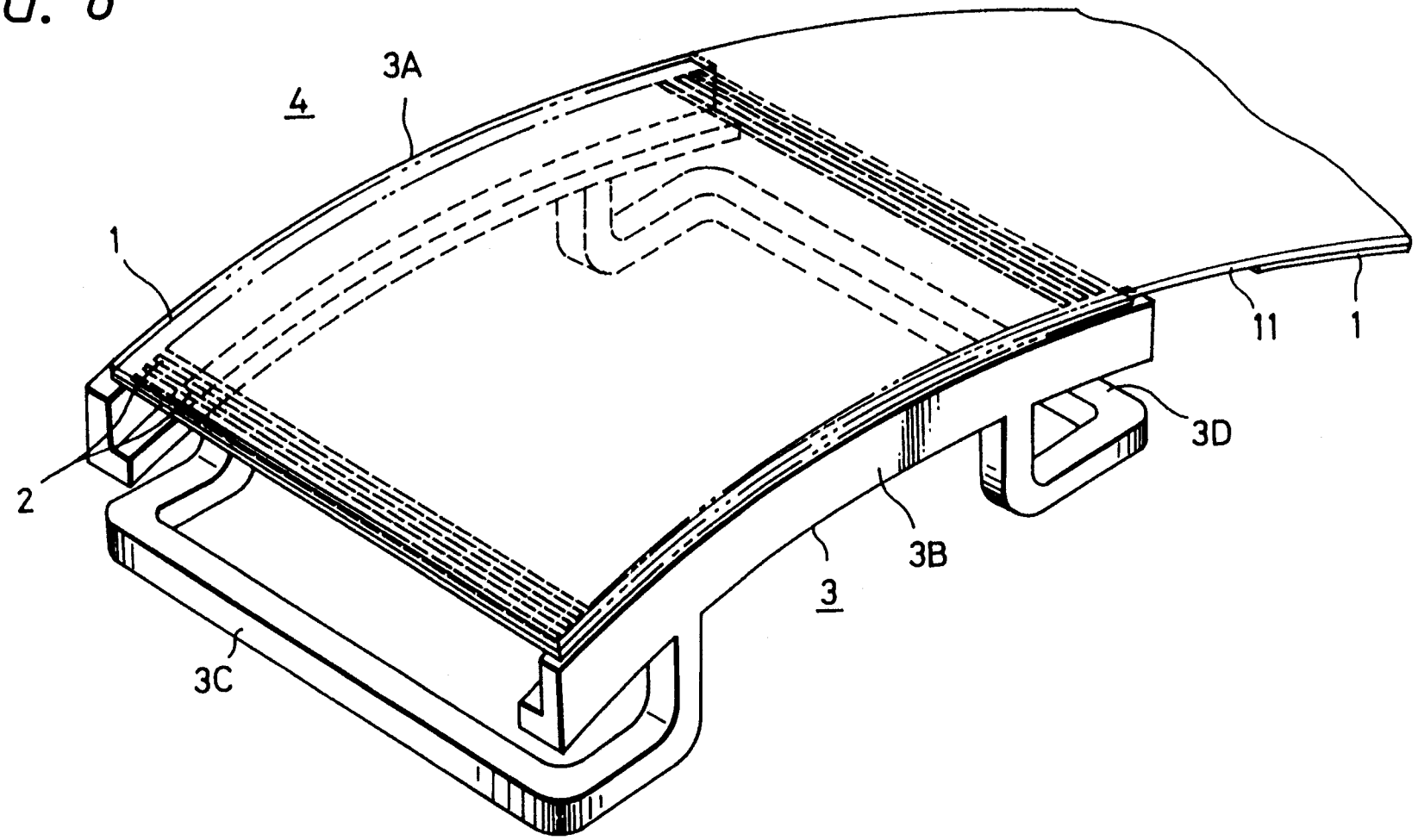
FIG. 8 is a color selecting mask produced by a method according to the present invention.

Thereafter, as shown in FIG. 8, one of the thin metal sheets 1 lined with the reactive repeelable adhesive sheet 11 is placed on the frame 3 of the color selecting mask 4.

The thin metal sheet 1 is installed on the frame 3 in the manner described above. The reactive repeelable adhesive sheet 11 may have predefined holes for allowing the thin metal sheet 1 to be welded to the frame 3 therethrough so that the presence of the reactive repeelable adhesive sheet 11 will not hamper the welding of the thin metal sheet 1 to the frame 3.

After the thin metal sheet 1 is welded to the frame 3, the thin metal sheet 1 attached to the frame 3 is peeled off the reactive repeelable adhesive sheet 11.

Since the thin metal sheet 1 which is composed of narrow, thin, and soft web portions between the slots or apertures 2 is mechanically supported on the reactive repeelable adhesive sheet 11, the thin metal sheet 1 on the reactive repeelable adhesive sheet 11 can easily be handled without being curved, flexed, intertwined, and hence wrinkled when the thin metal sheet 1 is apertured, fed, inspected, and welded to the frame 3.

As described above, the reactive repeelable adhesive sheet 11 is peeled off the thin metal sheet 1 after the thin metal sheet 1 is installed on the frame 3. The reactive repeelable adhesive sheet 11 can thoroughly be peeled off the thin metal sheet 1 without leaving adhesive spots on the thin metal sheet 1 because the reactive repeelable adhesive sheet 11 has been hardened by ultraviolet radiation.

After the reactive repeelable adhesive sheet 11 is applied to the thin metal sheet 21, no ultraviolet radiation should be applied to the reactive repeelable adhesive sheet 11 except when it is irradiated with ultraviolet radiation by the ultraviolet irradiator 50 shown in FIG. 15.

Figure 14B:
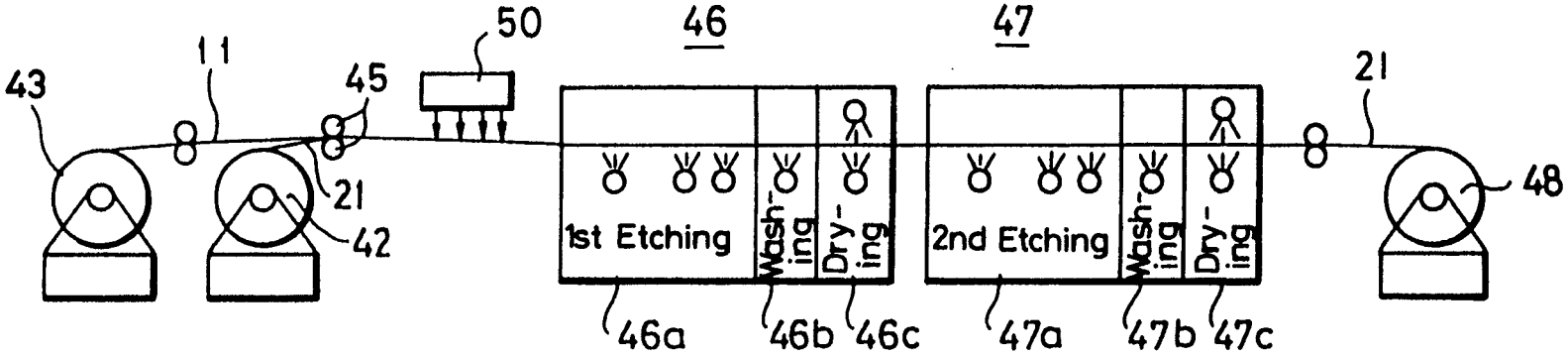
FIG. 14B is a schematic view illustrative of modified steps of the method according to the present invention.

However, if chemical and mechanical stability problems arise in the etching process shown in FIG. 14A with the reactive repeelable adhesive sheet 11 simply applied to the thin metal sheet 21, then the reactive repeelable adhesive sheet 11 may be hardened for chemical and mechanical stability by an ultraviolet irradiator 50 before the thin metal sheet 21 is selectively etched by the first and second etching devices 46, 47, as shown in FIG. 14B. In such a modification, the ultraviolet irradiator 50 shown in FIG. 15 may be dispensed with, or may be used to irradiate the reactive repeelable adhesive sheet 11 with ultraviolet radiation for greater peelability.

The steps shown in FIGS. 9 through 16 are actually successively carried out automatically rather than being effected independently.

The thin metal sheet 1, i.e., the thin metal sheet 21 may be made of iron, or an alloy containing iron, such as invar or the like, or may be made of any of various other metallic materials.

Figure 17:
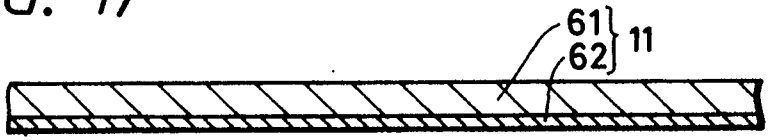
FIG. 17 is an enlarged cross-sectional view of the reactive repeelable pressure-sensitive adhesive sheet.

As shown in FIG. 17, the reactive repeelable adhesive sheet 11 comprises a sheet base 61 made of polyethylene terephthalate (PET), polypropylene (PP), polyethylene (PE), polybutylene terephthalate (PBT), polyethylene naphthalate (PEN), polyarylate (PA), polyether ether ketone (PEEK), polyether sulfone (PES), or the like and having a thickness ranging from 50 to 125

μm, the sheet base 61 having an optical transmittance of 50% or more with respect to ultraviolet radiation, for example, and a pressure-sensitive adhesive layer 62 coated on the sheet base 61.

The reactive repeelable adhesive sheet 11 in the form of an ultraviolet-curing pressure-sensitive adhesive sheet may comprise an acrylic pressure-sensitive adhesive sheet such as "PET-8800" (trade name) manufactured by Sony Chemicals Co. Ltd.

The acrylic pressure-sensitive adhesive sheet "PET-8800" comprises a sheet base of PET having a thickness of 125 μm and coated with an ultraviolet-reactive pressure-sensitive adhesive layer having a thickness of 30 μm.

The acrylic pressure-sensitive adhesive sheet "PET-8800" applied to a thin metal sheet 1 which comprised an aluminum-killed low-carbon steel sheet had a peeling strength of 70 g/2 cm before ultraviolet radiation was applied, and a peeling strength of 3 g/2 cm after ultraviolet radiation was applied. The peeling strengths were measured when the acrylic pressure-sensitive adhesive sheet "PET-8800" was peeled at 180° at a speed of 300 mm/minute. The ultraviolet radiation was emitted from a metal halide lamp of 160 W at an integrated intensity of 2.0 J/cm$^2$ and applied to the acrylic pressure-sensitive adhesive sheet "PET-8800" at a distance of 15 cm while the adhesive sheet was moving relatively to the metal halide lamp at a speed of 1 m/minute.

The reactive repeelable adhesive sheet 11 may be in the form of a heat-foaming pressure-sensitive adhesive sheet. The heat-foaming pressure-sensitive adhesive sheet may comprise a sheet base identical to the sheet base 61 described above and coated with an acrylic heat-foaming pressure-sensitive adhesive layer which has a pressure-sensitive adhesion capability before being heated. For example, the heat-foaming adhesive sheet may be one of No.3192H, , No.3193H, and No.3194H manufactured by Nitto Denko Sha.

Using the reactive repeelable adhesive sheet 11 in the form of a heat-foaming pressure-sensitive adhesive sheet, the color selecting mask 4 may be manufactured in substantially the same process as shown in FIGS. 8 through 16. In the case where a heat-foaming pressure-sensitive adhesive sheet is employed, since the adhesion of the heat-foaming adhesive sheet to the thin metal sheet 21 is not substantially impaired by the application of ultrasonic radiation, the heat-foaming pressure-sensitive adhesive sheet may be applied to the thin metal sheet 21 before the photoresist layer 51 coated on the thin metal sheet 21 is exposed as shown in FIG. 11.

Inasmuch as the reactive repeelable adhesive sheet 11 in the form of a heat-foaming pressure-sensitive adhesive sheet can be applied to the thin metal sheet 21 before or after the photoresist layer 51 is applied to the thin metal sheet 21 as described above with reference to FIG. 10, the thin metal sheet 21 which may be of a smaller thickness may be handled safely without being curved, flexed, or otherwise deformed.

Then, using the photoresist layer 51 as an etching mask in the same manner as described with reference to FIGS. 14A, 14B and 15, slots or apertures 2 are defined in the thin metal sheet 21 by selective etching. After the photoresist layer 51 is removed, a heating device 63 (see FIG. 15) such as a heater, an infrared lamp, or the like is energized to heat the heat-foaming adhesive sheet to a temperature ranging from 90° C. to 150° C. to cause the heat-foaming pressure-sensitive adhesive sheet to foam, thus increasing the peelability of the heat-foaming pressure-sensitive adhesive sheet from the thin metal sheet 21.

After or before the heat-foaming pressure-sensitive adhesive sheet is heated, each of the thin metal sheets 1 is inspected by the inspecting device 52. Each of the accepted thin metal sheets 1 is then installed on a frame 3, and thereafter the heat-foaming pressure-sensitive adhesive sheet is peeled off the thin metal sheet 1.

Since the thin metal sheet 1 is supported on the heat-foaming pressure-sensitive adhesive sheet, it can easily be handled without being curved, flexed, intertwined, and hence wrinkled when the thin metal sheet 1 is apertured, fed, inspected, and welded to the frame 3.

Alternatively, the reactive repeelable pressure-sensitive adhesive sheet 11 may comprise a thermosetting pressure-sensitive adhesive sheet whose peelability can be increased when heated. Therefore, as with the heat-foaming adhesive sheet, the thermosetting pressure-sensitive adhesive sheet can be applied to the thin metal sheet 21 before the photoresist layer 51 is exposed.

As described above, the thin metal sheet 1, which is very thin, has a large area, cannot sufficiently retain its shape by itself, has a low mechanical rigidity, and tends to be easily wrinkled with the slots or apertures 2 defined therein, is lined on its surface 1A with the reactive repeelable pressure-sensitive adhesive sheet 11 at least before the slots or apertures 2 are defined therein. Therefore, even after the slots or apertures 2 are defined in the thin metal sheet 1, the shape of the thin metal sheet 1 is retained by the reactive repeelable pressure-sensitive adhesive sheet 11. Consequently, the thin metal sheet 1 is prevented from being bent, curved, and hence wrinkled while it is being handled in any of the various processes, with the result that defective color selecting masks 4 are prevented from being manufactured.

The soft thin metal sheet 1 with the slots or apertures 2 defined therein is fixed in position by the reactive repeelable pressure-sensitive adhesive sheet 11 while the thin metal sheet 1 is being inspected. Accordingly, the thin metal sheet 1 can be inspected accurately. Heretofore, it has been customary to individually handle the soft thin metal sheet 1 with the slots or apertures 2 defined therein when it is inspected. For accurate measurements, it has been necessary to apply a large tension to the thin metal sheet 1, requiring a large and complex device and a large expenditure of labor to inspect the thin metal sheet 1, and it has been more liable for the thin metal sheet 1 to be damaged and become defective during inspection. According to the present invention, such a conventional drawback is reliably overcome.

When a plurality of thin metal sheets 1 with slots or apertures 2 defined therein are produced successively at certain intervals from an elongate continuous tape of thin metal sheet by selective etching, since the reactive repeelable pressure-sensitive adhesive sheet 11 has been attached to one surface of the elongate thin metal sheet, the thin metal sheets 1 are successively held on the reactive repeelable pressure-sensitive adhesive sheet 11, and hence can successively be inspected. Therefore, the process of inspecting the thin metal sheets 1 can be carried out automatically.

Inasmuch as the reactive repeelable pressure-sensitive adhesive sheet 11 is peeled off each of the thin metal sheets 1 after the thin metal sheet 1 is placed on and welded to the frame 3, each thin metal sheet 1 which has been rendered mechanically unstable with the slots or apertures 2 is not handled alone, but together with the reactive repeelable pressure-sensitive adhesive sheet 11. As a consequence, the color selecting mask 4 can reliably be manufactured with a high yield.

The reactive repeelable pressure-sensitive adhesive sheet 11, which may be in the form of an ultraviolet-curing pressure-sensitive adhesive sheet, a heat-foaming pressure-sensitive adhesive sheet, or a thermosetting pressure-sensitive adhesive sheet, has its peelability increased by being either irradiated with ultraviolet radiation or heated. Eventually, the reactive repeelable pressure-sensitive adhesive sheet 11 can thoroughly be peeled off the thin metal sheets 1 without leaving adhesive spots thereon, thus preventing a cathode-ray tube which incorporates the color selecting mask 4 from suffering a reduction in the vacuum which would otherwise be caused by organic materials produced by any remaining adhesive spots on the thin metal sheet 1, and hence from a reduction in the service life.

Having described preferred embodiments of the invention with reference to the accompanying drawings, it is to be understood that the invention is not limited to those precise embodiments and that various changes and modifications could be effected by one skilled in the art without departing from the spirit or scope of the invention as defined in the appended claims.

What is claimed is:

1. A method of manufacturing a color selecting member for use in a color cathode-ray tube, the color selecting member having a plurality of parallel slots defined transversely in a thin metal sheet, comprising the steps of:

(a) applying a peelable pressure-sensitive adhesive sheet to one surface of a thin metal sheet; and (b) selectively etching the thin metal sheet from an opposite surface thereof.

2. A method according to claim 1, wherein said peelable pressure-sensitive adhesive sheet comprises an ultraviolet-curing pressure-sensitive adhesive sheet.

3. A method according to claim 1, wherein said peelable pressure-sensitive adhesive sheet comprises a heat-foaming pressure-sensitive adhesive sheet.

4. A method according to claim 2, further comprising the step of applying ultraviolet radiation to said peelable pressure-sensitive adhesive sheet after said step (b).

5. A method according to claim 2, further comprising the step of applying ultraviolet radiation to said peelable pressure-sensitive adhesive sheet after said step (a).

6. A method according to claim 5, further comprising the step of applying ultraviolet radiation to said peelable pressure-sensitive adhesive sheet after said step (b).

7. A method according to claim 3, further comprising the step of heating said peelable pressure-sensitive adhesive sheet to foam after said step (b).

8. A method according to claim 1, further comprising the step of inspecting the selectively etched thin metal sheet after said step (b).

9. A method according to claim 1, further comprising the steps of:

(c) mounting said thin metal sheet under tension on a frame after said step (b); and (d) peeling said peelable pressure-sensitive adhesive sheet off said thin metal sheet after said step (c).

10. A method according to claim 1, wherein said thin metal sheet has a thickness of 0.15 mm or below.

11. A method of manufacturing a color cathode-ray tube having a color selecting member having a plurality of parallel slots defined transversely in a thin metal sheet, comprising the steps of:

(a) applying a peelable pressure-sensitive adhesive sheet to one surface of a thin metal sheet; and (b) selectively etching the thin metal sheet from ran opposite surface thereof.

12. A method according to claim 11, wherein said peelable pressure-sensitive adhesive sheet comprises an ultraviolet-curing pressure-sensitive adhesive sheet.

13. A method according to claim 11, wherein said peelable pressure-sensitive adhesive sheet comprises a heat-foaming pressure-sensitive adhesive sheet.

* * * * *